US006694121B2

(12) United States Patent
Seki

(10) Patent No.: US 6,694,121 B2
(45) Date of Patent: Feb. 17, 2004

(54) FIXING UNIT AND IMAGE FORMATION APPARATUS

(75) Inventor: Takayuki Seki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/252,060

(22) Filed: Sep. 23, 2002

(65) Prior Publication Data

US 2003/0077094 A1 Apr. 24, 2003

(30) Foreign Application Priority Data

Sep. 21, 2001 (JP) ..... 2001-288281

(51) Int. Cl.[7] ..... G03G 15/20

(52) U.S. Cl. ..... 399/330; 399/328; 399/331; 399/333; 219/216

(58) Field of Search ..... 215/216; 399/328, 399/330, 331, 333, 324; 430/124, 110.3, 111.4

(56) References Cited

U.S. PATENT DOCUMENTS

| | | | |
|---|---|---|---|
| 5,625,442 | A | 4/1997 | Seki |
| 5,749,037 | A | 5/1998 | Takayuki |
| 5,832,354 | A | 11/1998 | Kouno et al. |
| 5,915,147 | A | 6/1999 | Kouno et al. |
| 5,970,298 | A | 10/1999 | Seki et al. |
| 6,305,636 | B1 | 10/2001 | Satoh et al. |

FOREIGN PATENT DOCUMENTS

| | | |
|---|---|---|
| JP | 8-082951 | 3/1996 |
| JP | 8-166736 | 6/1996 |
| JP | 8-272255 | 10/1996 |
| JP | 10-026895 | 1/1998 |
| JP | 11-184300 | 7/1999 |
| JP | 2000-267340 | 9/2000 |

*Primary Examiner*—Hoang Ngo
(74) *Attorney, Agent, or Firm*—Oblon, Spivak, McClelland, Maier & Neustadt, P.C.

(57) ABSTRACT

The present invention is to provide a fixing unit which includes a fixing rotating member and a pressuring rotation member to be heated by a heat source while forcing with each other and rotating, which fixes an image by having a recording material with an image developed by a developer containing a toner having a 5 to 10 $\mu$m volume average particle size, and 60 to 80 numerical % of particles of 5 $\mu$m or less passing through a forcing section of the fixing rotating member and the pressuring rotating member, wherein the surface resistance value of the pressuring rotating member is in a range of $10^9$ Ω to $10^{11}$ Ω.

6 Claims, 5 Drawing Sheets

FIXING UNIT AND IMAGE FORMATION APPARATUS

BACKGROUND OF THE INVENTION

1) Field of the Invention

The present invention relates to a fixing unit which fixes a developed image, and an image formation apparatus represented by a copying machine, a facsimile, a printer, a scanner, and a composite machine thereof.

2) Description of the Related Art

In an image formation apparatus such as a copying machine, a printer and a facsimile apparatus, a fixing unit is provided for fixing a visible image transferred from an image supporting member such as a photosensitive material to a recording material. For the fixing unit, when the visible image is a toner image, a configuration comprising a fixing rotating member to be heated to a temperature capable of melting the toner, and a pressuring rotating member for contacting the toner image with the fixing rotating member is provided.

As to the toner image transferred on a recording material, the toner adhesion amount irregularity is generated in the direction perpendicular to the image formation surface of the recording material, that is, in the toner adhesion height direction due to factors such as the toner particle size, the charge amount irregularity on the image supporting member surface, the edge effect with a toner adhesion amount increase at the rim of the image and the image density.

As a method for fixing a toner image on a recording material, a roller fixing method of providing a fixing rotating member and a pressuring rotating member as a roller for forming a forcing section as a fixing nip section by forcing them with each other and providing the fixing rotating member as a heating roller, and a belt fixing method of providing a fixing rotating member as an endless belt placed around roller members and a pressuring rotating member as a roller for forming a forcing section as a fixing nip section by forcing the roller and the endless belt and heating the endless belt directly or indirectly, can be presented. In particular, according to the roller fixing method, since the toner image and the heating roller are contacted directly with a relatively high pressure so as to provide heat to the toner evenly, it is a fixing method with a good thermal efficiency, and thus it is used widely.

Among the heating rollers as the fixing rotating member used in the roller fixing method, there are those referred to as the hard type with a mold releasing layer by about 10 to 30 $\mu$m on the surface of a mandrel of an aluminum based or iron based metal material. For the mold releasing layer of the hard type heating roller, a fluorine resin material, or the like such as a PFA and a PTFE is used. Therefore, the surface hardness of the hard type heating roller is substantially equal to the hardness of the surface of the mandrel so that the toner image transferred on the recording material can be crushed to an even height by the fixing nip section. However, since the toner image has the adhesion amount irregularity in the toner adhesion height direction, degree of crushing the image differs between the part with a low toner adhesion height and the part with a high toner adhesion height. Specifically, the image in the high part is spread in the paper surface direction compared with the low part.

Therefore, in order to prevent the image spread irregularity in the paper surface direction derived from crushing the toner to the even height, a heating roller called soft type with an elastic layer provided on the surface of an aluminum based or an iron based metal material for facilitating deformation of the roller surface is proposed. As the material of the elastic layer used for the soft type heating roller, a fluorine rubber, a silicone rubber or a mixture of a resin and a rubber is used. As the soft type heating roller, there is one with the elastic layer surface covered with a PFA tube in consideration of the wear resistance of the roller surface.

In the field of the image formation, with propagation to a wide range of users of an image inputting apparatus such as a scanner and a digital camera, an apparatus having an image recording/editing function such as a computer, and an image outputting apparatus such as a printer and an MFP, a high image quality of the outputted image, a high quality and a high productivity (high speed printing) are highly requested. In particular, needs of the high image quality are highly required so that the reproductivity of the image details attracts the attention. In order to accurately reproduce the details, it is apparent that influence of the toner particle size used for the image formation is significant, that is, with a smaller particle, more detailed reproduction can be enabled. For example, the Japanese Patent Application Laid Open (JP-A) No. 8-82951 proposes an image formation apparatus a small size toner having 6 to 9 $\mu$m volume average particle size, 10 to 40 numerical % of particles of 5 $\mu$m or less, and 0 to 20 numerical % of particles of 4 $\mu$m or less compared with the conventional toner having 9.5 $\mu$m volume average particle size, and 30 numerical % of particles of 5 $\mu$m or less, and an image formation apparatus using the same.

In the case of an image developed with a toner having a relatively large particle size of 9.5 $\mu$m volume average particle size, and 30 numerical % of particles of 5 $\mu$m or less, the image ruggedness on the recording material, that is irregularity of the adhesion amount in the toner height direction is drastic so that the image tends to be swelled after the fixation. This tendency is conspicuous in the case of fixing with a soft type heating roller rather than the case of fixing with a hard type heating roller. Therefore, when a soft type heating roller is used, the image fixed on the recording material can easily be peeled off. In order to fulfill the demand for the high image quality with such a toner with a relatively large particle size, the elastic layer thickness needs to be about 0.5 mm to several mm. However, when the elastic layer is thick, heat supply from the roller inside to the roller surface is delayed so that the demand for the high speed printing cannot be achieved.

With a small size toner, since the charge amount per one toner is high, when a recording material with an image formed by such a toner is conveyed to the fixing nip section charged by friction by rotation in a state forced with each other, the toner may be scattered due to generation of discharge by nipping, or the toner may be repelled from the recording material by the repulsion force by the same pole so as to be adhered on the heating roller side depending on the polarity of the toner and the polarity of the heating roller or the pressuring roller comprising the fixing nip section.

In such a small size toner, in order to reduce the ratio of particles having 5 $\mu$m or less particle size to 10 to 40 numerical %, the toner of 5 $\mu$m or less particle size is eliminated. Thereby, the production step is complicated so as to provide a cause of the cost increase.

From this point of view, a toner with elimination of the toner having 5 $\mu$m or less particle size executed as little as possible, for example, a toner "having 4 to 7 $\mu$m volume average particle size and containing 60 to 80 numerical % of toner particles having 5 $\mu$m or less particle size" as disclosed in the Japanese Patent Application Laid-Open (JP-A) No. 2000-267340 has been developed.

However, as mentioned above, when a small size toner having 5 μm particle size accounts for more than half or the entire developer, since the flowability tends to be lowered according to the fineness of the toner, a silica, a titanium oxide, or the like is added by a certain amount for ensuring the flowability sometimes. However, with the improvement of the flowability, the toner can easily be scattered by the external force such as the static electricity so that the image scattering is generated so as to prevent achievement of the high image quality effect by the small size toner.

SUMMARY OF THE INVENTION

It is an object of the present invention to provide a developer capable of reducing swelling of the image after fixation and preventing peel off of the image while fulfilling the demand for the high image quality by making finer the particle size of the toner used for the image formation.

It is another object of the present invention to provide a fixing unit and an image formation apparatus capable of reducing swelling of the image after fixation and preventing peel off of the image while fulfilling the demand for the high image quality by making finer the particle size of the toner used for the image formation.

It is still another object of the present invention to provide a fixing unit and an image formation apparatus capable of reducing swelling of the image after fixation and achieving high speed printing while fulfilling the demand for the high image quality by making finer the particle size of the toner used for the image formation.

It is still another object of the present invention to provide a fixing unit and an image formation apparatus capable of reducing swelling of the image after fixation and reducing image scattering by discharge generated at the time of entrance to the fixing nip section while fulfilling the demand for the high image quality by making finer the particle size of the toner used for the image formation.

In one aspect of the present invention, a fixing unit which includes a fixing rotating member and a pressuring rotation member to be heated by a heat source while forcing with each other and rotating, and which fixes an image by having a recording material with an image developed by a developer containing a toner having a 5 to 10 μm volume average particle size, and 60 to 80 numerical % of particles of 5 μm or less passing through a forcing section of the fixing rotating member and the pressuring rotating member, wherein the surface resistance value of the pressuring rotating member is in a range of $10^9$ Ω to $10^{11}$ Ω.

In one another aspect of the present invention, a fixing unit which includes a fixing rotating member and a pressuring rotation member to be heated by a heat source while forcing with each other and rotating, and which fixes an image by having a recording material with an image developed by a developer containing a toner having a 5 to 10 μm volume average particle size, and 60 to 80 numerical % of particles of 5 μm or less passing through a forcing section of the fixing rotating member and the pressuring rotating member, wherein the fixing rotating member comprises an elastic layer formed around the mandrel thereof, and a mold releasing layer formed on the surface of the elastic layer, with the elastic layer thickness provided in a range of 0.1 mm to 0.5 mm, and the mold releasing layer thickness provided in a range of 50 μm or less.

In one still another aspect of the present invention, a fixing unit which includes a fixing rotating member and a pressuring rotation member to be heated by a heat source while forcing with each other and rotating, and which fixes an image by having a recording material with an image developed by a developer containing a toner having a 5 to 10 μm volume average particle size, and 60 to 80 numerical % of particles of 5 μm or less passing through a forcing section of the fixing rotating member and the pressuring rotating member, wherein the fixing rotating member comprises an elastic layer formed around the mandrel thereof, and a mold releasing layer formed on the surface of the elastic layer, with the elastic layer thickness provided in a range of 0.1 mm to 0.5 mm, the mold releasing layer thickness provided in a range of 50 μm or less, and the surface resistance value of the pressuring rotating member provided in a range of $10^9$ Ω to $10^{11}$ Ω.

In one still another aspect of the present invention, an image formation apparatus comprising, a fixing unit which includes a fixing rotating member and a pressuring rotation member to be heated by a heat source while forcing with each other and rotating, and which fixes an image by having a recording material with an image developed by a developer containing a toner having a 5 to 10 μm volume average particle size, and 60 to 80 numerical % of particles of 5 μm or less passing through a forcing section of the fixing rotating member and the pressuring rotating member, wherein the surface resistance value of the pressuring rotating member is in a range of $10^9$ Ω to $10^{11}$ Ω.

In one still another aspect of the present invention, an image formation apparatus comprising, a fixing unit which includes a fixing rotating member and a pressuring rotation member to be heated by a heat source while forcing with each other and rotating, and which fixes an image by having a recording material with an image developed by a developer containing a toner having a 5 to 10 μm volume average particle size, and 60 to 80 numerical % of particles of 5 μm or less passing through a forcing section of the fixing rotating member and the pressuring rotating member, wherein the fixing rotating member comprises an elastic layer formed around the mandrel thereof, and a mold releasing layer formed on the surface of the elastic layer, with the elastic layer thickness provided in a range of 0.1 mm to 0.5 mm, and the mold releasing layer thickness provided in a range of 50 μm or less.

In one still another aspect of the present invention, an image formation apparatus comprising, a fixing unit which includes a fixing rotating member and a pressuring rotation member to be heated by a heat source while forcing with each other and rotating, and which fixes an image by having a recording material with an image developed by a developer containing a toner having a 5 to 10 μm volume average particle size, and 60 to 80 numerical % of particles of 5 μm or less passing through a forcing section of the fixing rotating member and the pressuring rotating member, wherein the fixing rotating member comprises an elastic layer formed around the mandrel thereof, and a mold releasing layer formed on the surface of the elastic layer, with the elastic layer thickness provided in a range of 0.1 mm to 0.5 mm, the mold releasing layer thickness provided in a range of 50 μm or less, and the surface resistance value of the pressuring rotating member provided in a range of $10^9$ Ω to $10^{11}$ Ω.

In one still another aspect of the present invention, an image formation apparatus using a developer containing a toner having a 5 to 10 μm volume average particle size, and 60 to 80 numerical % of particles of 5 μm or less.

Other objects and features of this invention will become understood from the following description with reference to the accompanying drawings.

DETAILED DESCRIPTION

Figure 1:
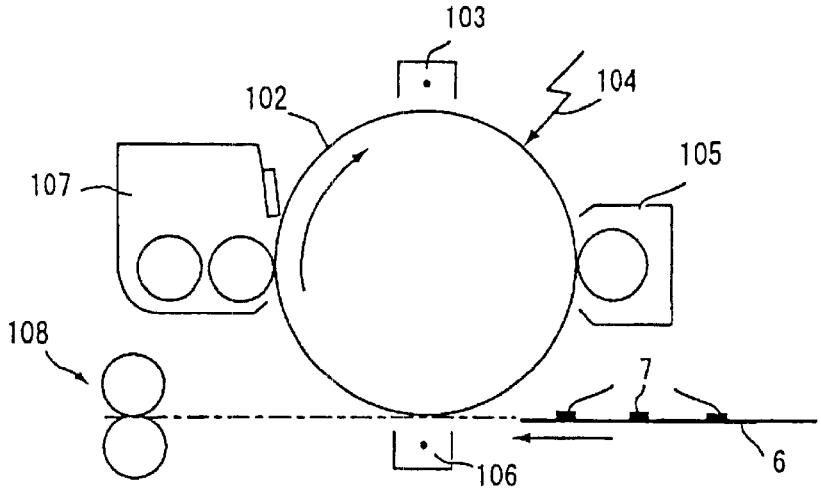
FIG. 1 is a schematic diagram which shows an embodiment of an image formation apparatus according to the present invention.

Hereinafter, embodiments of the present invention will be explained. FIG. 1 shows an image formation apparatus comprising a fixing unit according to an embodiment of the present invention. The image formation apparatus is a copying machine, capable of forming an electrostatic latent image by an exposing light. The copying machine shown in FIG. 1 comprises a photosensitive drum 102 as an image supporting member. The photosensitive drum 102 is rotated clockwise in the figure according to the drive of an unshown driving motor. Around the photosensitive drum 102, a charging unit 103 which executes an image formation process in the drum rotation process, an exposing unit 104, a developing unit 105, a transfer unit 106 and a cleaning unit 107 are disposed. The image supporting member may be a belt-like photosensitive member, or of an embodiment with a belt-like or roller-like intermediate transfer member and a photosensitive member both provided.

In the copying machine, an electrostatic latent image is formed on the photosensitive drum 102 by the laser beam as the exposing light outputted from the exposing unit 104 after uniform charging by the charging unit 103. The electrostatic latent image has a visible image process (development) using a toner supplied from the developing unit 105 so as to be a toner image. The toner image on the photosensitive drum 102 developed by the developing unit 105 is transferred to a paper 6 as a recording material fed out from an unshown paper feeding unit at a transfer position between the transfer unit 106 and the photosensitive drum 102. From the photosensitive drum 2 after the transfer, an untransferred toner and residual charge are eliminated by the cleaning unit 107. After uniform charging by the charging unit 103, it is prepared for the next image formation.

In this embodiment, as the developer used in the developing unit 105, one containing a toner having 5 to 10 $\mu$m volume average particle size, and 60 to 80 numerical % of particles of 5 $\mu$m or less is used. As the configuration of the developer, one containing a resin component and a coloring agent with a wax component and inorganic fine particles added can be adopted as well. The production method is not particularly limited, and both the pulverization method and the polymerization method can be used.

As the resin component, any of the conventionally known resins can be used. For example, the followings can be presented. Examples thereof include styrene resins (styrene or a single polymer or a copolymer containing a styrene substituent) such as a styrene, a poly-$\alpha$-stilstyrene, a styrene-chlorostylene copolymer, a styrene-propylene copolymer, a styrene-butadiene copolymer, a styrene-vinyl chloride copolymer, a styrene-vinyl acetate copolymer, a styrene-maleic acid copolymer, a styrene-ester acrylate copolymer, a styrene-ester methacrylate copolymer, a styrene-$\alpha$-methyl chloracrylate copolymer, and a styrene-acrylonitrile-ester acrylate copolymer, a polyester resin, an epoxy resin, a vinyl chloride resin, a rosin modified maleic acid resin, a phenol resin, a polyethylene resin, a polyester resin, a polypropylene resin, a petroleum resin, a polyurethane resin, a ketone resin, an ethylene-ethyl acrylate copolymer, a xylene resin, and a polyvinyl butylate resin. Moreover, these can be used alone or in a combination of two or more kinds.

As the coloring agent, those conventionally known such as a carbon black, a lamp black, an iron black, an ultramarine blue, a nigrosine dye, an aniline blue, a chalco oil blue, an oil black, and an azo oil black can be used, and it is not particularly limited. As the wax component, those conventionally known such as a carnauba wax, a rice wax, and a synthetic ester wax can be used, and thus it is not particularly limited. As the inorganic fine particles, those conventionally known such as a silica and titanium oxide fine powders can be used. In this embodiment, since the toner is extremely fine, a silica is added for ensuring the flowability.

To the paper 6 with the toner image transferred, the toner image is fixed by a fixing unit 108 disposed in the conveyance path shown by the chain line elongating from the transfer position to an unshown paper discharging section.

Figure 2:
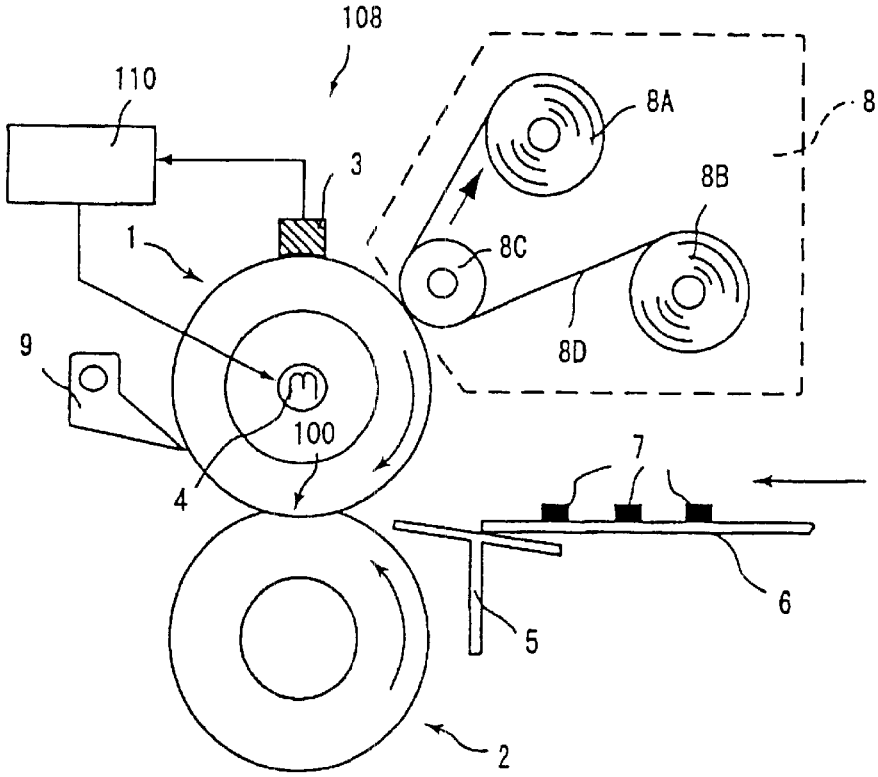
FIG. 2 is an enlarged diagram which shows the principal part configuration of a fixing unit used for the image formation apparatus shown in FIG. 1.

As shown in FIG. 2, the fixing unit 108 comprises a heating roller 1 as a fixing rotating member with a heater 4 as the heat source stored, and a pressuring roller as a pressuring rotating member having the dielectric property. The heating roller 1 and the pressuring roller 2 are contacted and disposed facing with each other with the paper 6 conveyance path disposed therebetween so as to be rotated while forcing with each other according to rotation of the heating roller 1 by an unshown driving motor. In the fixing unit 108, the roller fixing method of having the paper 6 with the toner image formed passing through a fixing nip section 100 as the forcing section of the heating roller 1 and the pressuring roller 2 for fixing the toner on the paper 6 by heating and melting the toner by applying heat and pressure from the heating roller 1 heated by the heater 4 with respect to the toner image 7, is adopted.

Near the heating roller 1, a separating nail 9 for peeling off the paper 6 from the heating roller 1, a temperature sensing element 3 which senses the surface temperature of the heating roller 1, and a fixing cleaning unit 8 are disposed clockwise with the fixing nip section 100 disposed at the center. The fixing cleaning unit 8 for applying an oil or cleaning for cleaning the surface of the heating roller 1, comprises a pair of rollers 8A, 8B. One of the rollers 8A comprises a taking up roller for a cleaning web 8D to be contacted with the surface of the heating roller 1, and the other roller 8B comprises a feeding out roller for the cleaning web 8D. The cleaning web 8D is provided so as to pressure and contact with the surface of the heating roller 1 by the pressuring roller 8C pressured and forced against the heating roller 1 by an unshown elastic member such as a spring.

The temperature sensing element 3 contacted with the surface of the pressuring roller 1 which senses the temperature of the roller surface inputs a sensing signal to a controlling unit 110. The controlling unit 110 comprising a known microcomputer as the principal part thereof executes the on/off control of the heater 4 such that the sensing value inputted from the temperature sensing element 3 can be constant. Therefore, the surface temperature of the heating roller 1 is maintained in a temperature range sufficient for melting the toner and suited for fixing. That is, according to the temperature control, the heating roller 1 is maintained in the control temperature range by restraining the temperature rise of the heating roller by cutting off the power supply to the heater 4 when the temperature measured by the temperature sensing element 3 is high compared with the preset controlling temperature upper limit, and by preventing the temperature drop of the heating roller 1 by supplying the power to the heater 4 when the temperature measured by the temperature sensing element 3 is low compared with the preset controlling temperature lower limit of the heating roller 1.

Figure 3:
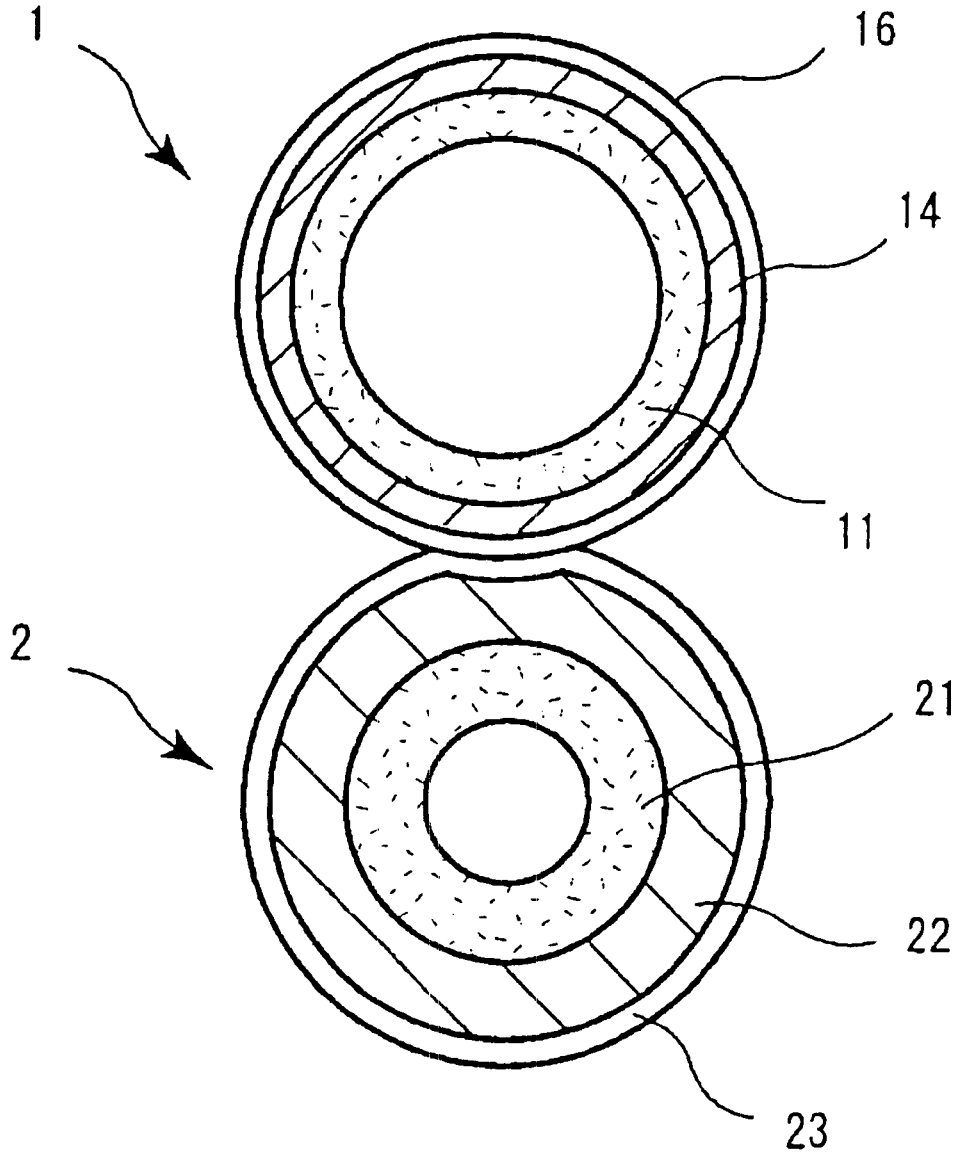
FIG. 3 is an enlarged cross-sectional view which shows an embodiment of a fixing rotating member and a pressuring rotating member.

As shown in FIG. 3, as the heating roller 1, a soft type comprising an elastic layer 14 formed around a hollow mandrel 11 and a mold releasing layer 16 formed on the surface of the elastic layer 14, with the elastic layer 14 thickness in a range of 0.1 mm to 0.5 mm, and the mold releasing layer 16 thickness of 50 $\mu$m or less is used. As the material of the elastic layer 14, a fluorine rubber, a silicone rubber or a mixture of a resin and a rubber is used. As the material of the mold releasing layer 16, a fluorine resin is used. As the fluorine resin, a PFA tube is used. In FIG. 3, the heater 4 shown in FIG. 2 is not described, but the heater 4 is provided in the internal space of the mandrel 11.

The pressuring roller 2 comprises an elastic layer 22 made of a fluorine rubber, a silicone rubber, or the like covering the outside of the mandrel 21, and a mold releasing layer 23 made of a PFA tube, or the like covering the surface of the elastic layer 22. As the pressuring roller 2, an embodiment without the mold releasing layer 23 can be adopted.

Figure 7A:
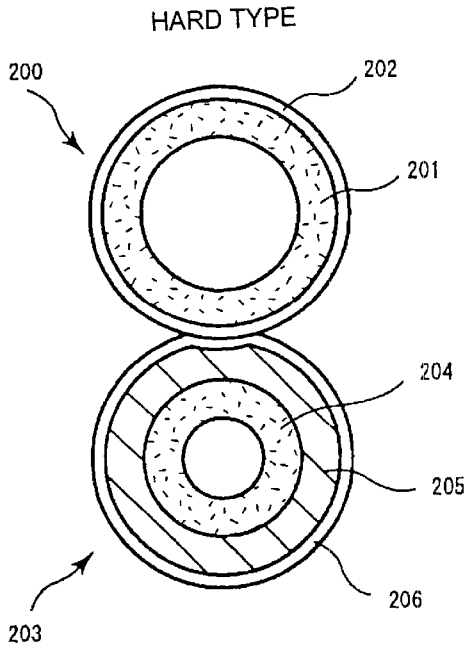
FIGS. 7A and 7B are cross-sectional view which shows the configurations of the conventional hard type and soft type fixing rotating member and pressuring rotating member.

FIG. 7A shows the conventional hard type heating roller 200 and pressuring roller 203. The heating roller 200 comprises a mandrel 201 and a mold releasing layer 202 covering the surface thereof. As the mold releasing layer 12, a fluorine resin such as a PFA and a PTFE is provided by 10 $\mu$m to 30 $\mu$m. The pressuring roller 203 comprises a mandrel 204 and an elastic layer 205 made of a fluorine rubber, a silicone rubber, or the like covering the outside thereof, and a mold releasing layer 206 made of a PFA tube, or the like covering the surface of the elastic layer 205.

Figure 7B:
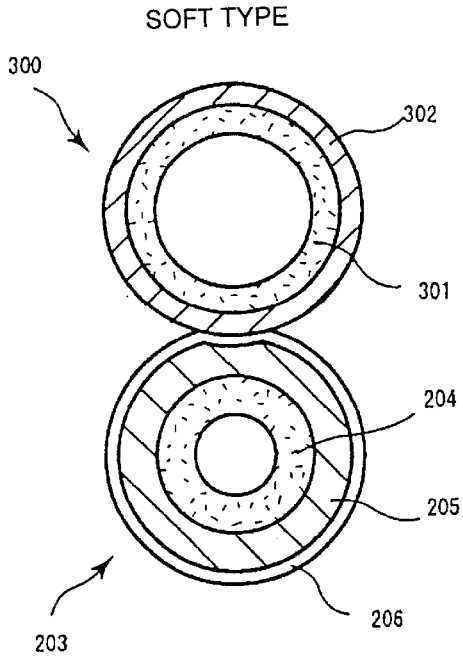

FIG. 7B shows the conventional soft type heating roller 300 and pressuring roller 203. The heating roller comprises a mandrel 301 and an elastic layer 302 of about a 0.5 mm to several mm thickness covering the surface thereof. As the material of the elastic layer 302, a fluorine rubber, a silicone rubber, or a mixture of a resin and a rubber is used. Furthermore, the surface of the elastic layer 302 may be covered with a mold releasing layer.

Figure 4:
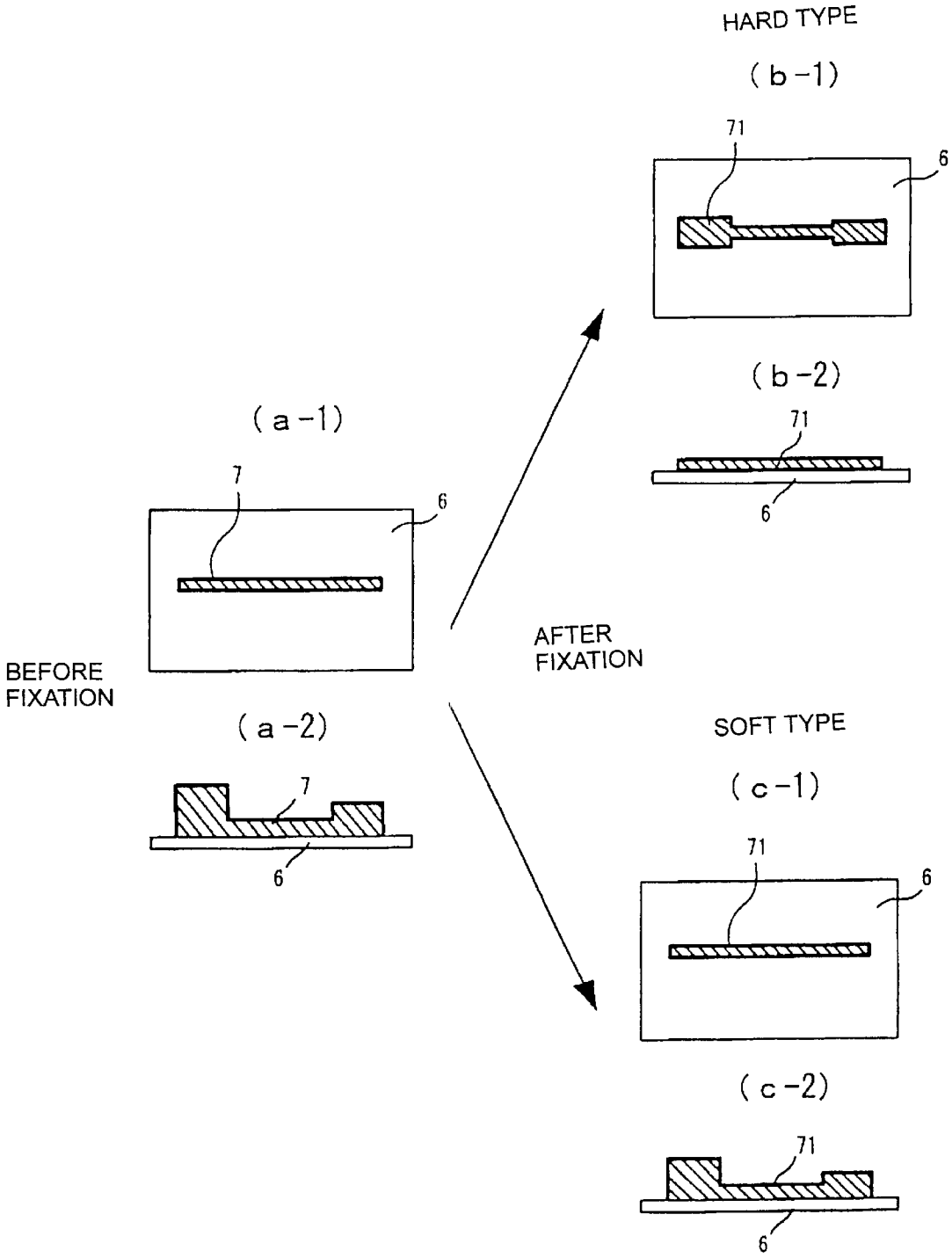
FIG. 4 is a diagram which shows the states of a graphic image before and after fixation.
Figure 5:
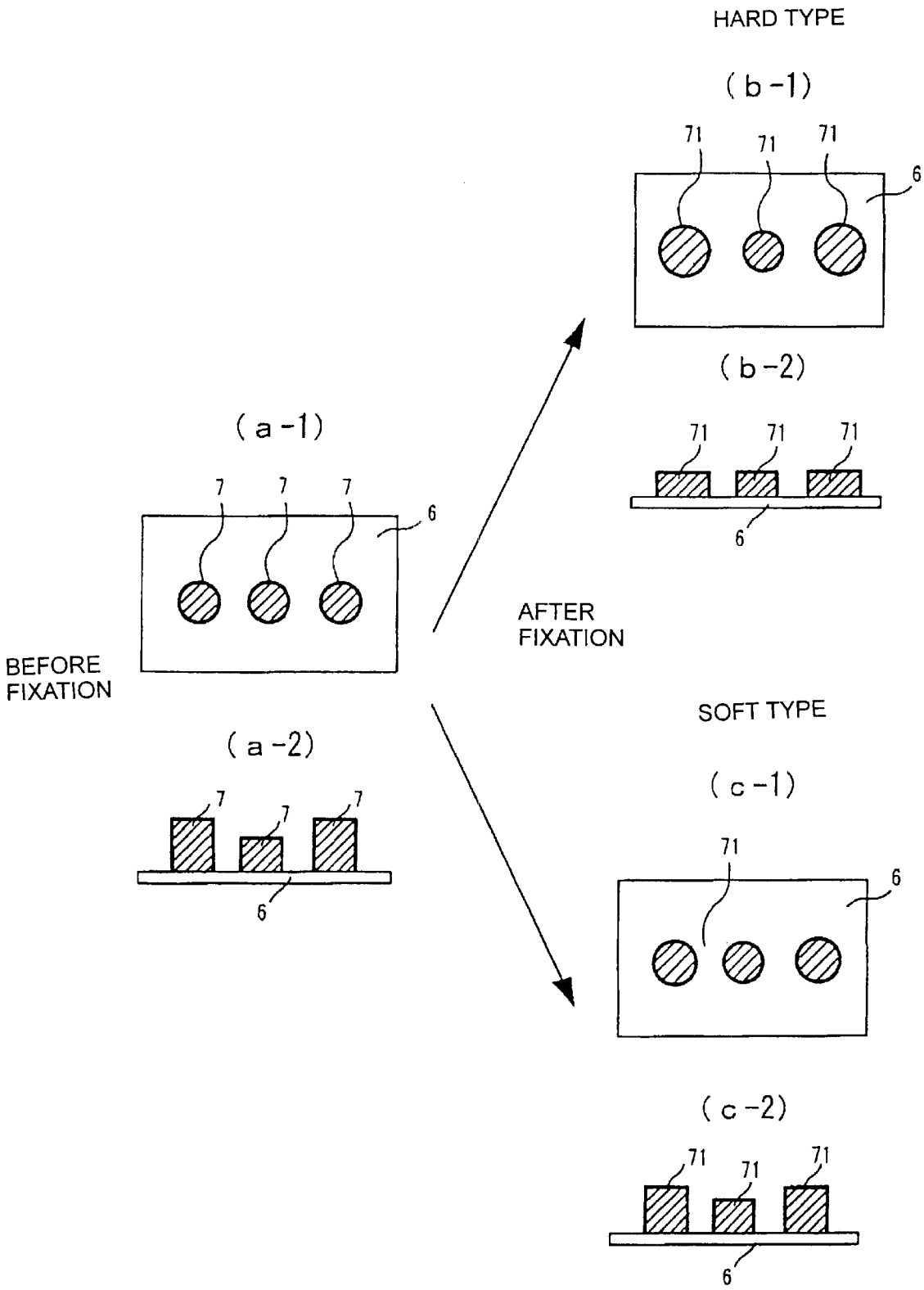
FIG. 5 is a diagram which shows the states of a dot image before and after fixation.

FIGS. 4 and 5 show the difference of the images before fixation and the images after fixation between the case of using the conventional hard type heating roller 200 and pressuring roller and the case of using the soft type heating roller 1 and pressuring roller 2 of the present invention. As the conditions at the time, all the conditions such as the temperature, the linear velocity of each roller, and the used toner are provided equally except the roller conditions used for the fixation.

FIG. 4 shows the case of a graphic image as the toner image 7 transferred on the paper 6. In the figure, (a-1), (b-1), (c-1) are diagrams which view the graphic image 7 on the paper 6 from above, and (a-2), (b-2), (c-2) are diagrams which view the graphic image 7 on the paper 6 from sideways. As shown in FIG. 4(*a*-1), the unfixed graphic image 7 with an even width has a different toner height depending on the position as shown in FIG. 4(*a*-2). In the case of using the hard type, although the height of the graphic image 71 after the fixation is constant as shown in FIG. 4(*b*-2), a part with a high toner height and a part with a low toner height, that is, a part with a large toner adhesion amount and a part with a small toner adhesion amount have uneven graphic image 71 width after the fixation as shown in FIG. 4(*b*-1).

In contrast, when the soft type pressuring roller 1 of the present invention is used, since the roller surface is soft so as not to crush the toner forcibly to an even height, although the graphic image 71 height after the fixation is uneven as shown in FIG. 4(*c*-2), the phenomenon with the graphic image 71 width unevenness is not observed as shown in FIG. 4(*c*-1). Moreover, although the graphic image 71 height is uneven, since the uneven difference can be made smaller owing to the extremely small toner size compared with that of the conventional toner.

FIG. 5 shows the case of a dot image (digital image) comprising dots as the toner image 7 transferred on the paper 6. In the figure, (a-1), (b-1), (c-1) are diagrams which view the dot image 7 on the paper 6 from above, and (a-2), (b-2), (c-2) are diagrams which view the dot image 7 on the paper 6 from sideways. As shown in FIG. 5(*a*-1), the unfixed dot image 7 with an even dot size has a different toner height depending on the dot as shown in FIG. 5(*a*-2). In the case of using the hard type, although the height of the dot image 71 after the fixation is constant as shown in FIG. 5(*b*-2), a dot with a high toner height and a dot with a low toner height, that is, a part with a large toner adhesion amount and a part with a small toner adhesion amount have uneven dot image 71 size after the fixation as shown in FIG. 5(*b*-1).

In contrast, when the soft type pressuring roller 1 of the present invention is used, since the roller surface is soft so as not to crush the toner forcibly forcibly to an even height, although the dot image 71 height is uneven as shown in FIG. 5(*c*-2), the phenomenon with the dot image 71 size unevenness is not observed as shown in FIG. 5(*c*-1). Also in this case, although the graphic image 71 height is uneven, since the uneven difference can be made smaller owing to the extremely small toner size compared with that of the conventional toner.

Figure 6A:
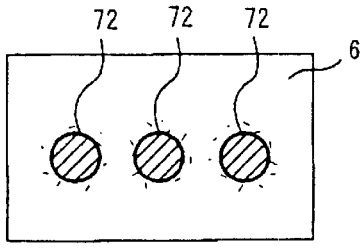
FIGS. 6A and 6B are diagrams which show the states of a graphic image and a dot image after fixation by the conventional soft type fixing rotating member.
Figure 6B:
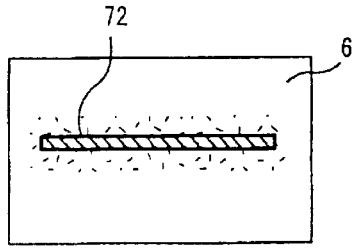

FIGS. 6A and 6B shows the states of a toner image at the time of fixation using the conventional soft type heating roller 300 and pressuring roller 203 shown in FIG. 7B. FIG. 6A shows a dot image 72, and FIG. 6B shows a graphic image 72. As the conditions at the time, as in the case shown in FIGS. 4 and 5, all the conditions are provided equally except the used roller conditions.

When the conventional soft type heating roller 300 is used, although the graphic image 72 width and the dot image 72 dot size can be even, due to highly charged fine powdery toner, the toner is scattered so as to be adhered near the image after fixation so that the sharpness of the image is deteriorated and a blurred image is provided. Moreover, depending on the toner scattering level, irregularity may be generated in the line width and the dot size, or an unfixed image is offset on the heating roller 300 so as to be transferred on the paper 6 twice.

The image scattering generation degree according to the pressuring roller 2 resistance value and the small diameter toner ratio will be explained with reference to the table 1. In the table 1, O denotes the case without generation of image scattering, and x denotes the state with image scattering generation. As the measurement conditions at the time, only the pressuring roller 2 resistance value and the ratio of the toner of 5 μm or less are changed and the conditions at the time of fixations are provided equally.

TABLE 1

IMAGE SCATTERING GENERATION DEGREE WITH RESPECT TO THE PRESSURING ROLLER RESISTANCE VALUE

| Pressuring roller resistance value | Ratio of the toner of 5 μm or less (%) | | |
|---|---|---|---|
| (Ω) | 20–40% | 40–60% | 60–80% |
| $10^7$ | ○ | × | × |
| $10^8$ | ○ | ○ | × |
| $10^9$ | ○ | ○ | ○ |
| $10^{10}$ | ○ | ○ | ○ |
| $10^{11}$ | ○ | ○ | ○ |

Image scattering
○ OK
× NG

As it is apparent from the table 1, when the toner of a 5 μm or less particle size is contained by 60 to 80 numerical %, image scattering is generated unless the pressuring roller 2 surface resistance value is $10^9$ Ω or more. When the toner of a 5 μm or less particle size is contained by 40 to 60 numerical %, image scattering is generated unless the pressuring roller 2 surface resistance value is $10^8$ Ω or more. In contrast, when the toner of a 5 μmor less particle size is contained by 20 to 40 numerical %, image scattering is not generated regardless of the pressuring roller 2 surface resistance value. In the case of a relatively large toner having the toner of a 5 μm or less particle size by 20 to 40 numerical %, an additive for improving the flowability is contained by a small amount, and with a larger ratio of a small size toner as in the case of the present invention, a ratio of an additive for improving the flowability is large, and thus image scattering can easily be generated with a larger ratio of the small size toner in the developer. Moreover, when the pressuring roller 2 surface resistance value is 10 Ω or more, offset can easily be generated by influence of discharge at the time of entrance of the paper 6 to the fixing nip section 100, or the like from the charge characteristics.

Therefore, in the case of having 60 to 80 numerical % of a toner of a 5 μm or less particle size as in this embodiment, in order to effectively restrain generation of image scattering, it is preferable to set the pressuring roller 2 surface resistance value at $10^9$ Ω to $10^{11}$ Ω. In this embodiment, since the mold releasing layer thickness of the heating roller 1 is set at 50 μm or less, and the elastic layer thickness is set in a range of 0.1 mm to 0.5 mm so as to be provided extremely thinly, the distance from the heater 4 to the heating roller 1 surface can be made shorter so that the heating time for the roller surface, that is, the rise time for having a temperature necessary for the fixation can be made shorter. Therefore, even when the paper 6 is conveyed to the fixing nip section 100 shown in FIG. 2 continuously at a high speed, generation of fixing failure due to insufficiency of the surface temperature of the heating roller 1 can be restrained so that high speed image printing can be achieved while providing a high image quality.

Although the case with the heating roller 1 as the fixing rotating member has been explained in this embodiment, an endless belt placed around a plurality of roller member can be used as the fixing rotating member. Also in this case, the same effect can be obtained by forming a mold releasing layer on the surface of the elastic layer, having the elastic layer thickness in a range of 0.1 mm to 0.5 mm, and having the mold releasing layer thickness by 50 μm or less. For heating the endless belt, a heat source may be provided inside the roller members, or a heat source may be disposed near the endless belt for heating the belt.

According to one aspect of the present invention, since a developer having an extremely fine toner having a 5 to 10 μm volume average particle size, and 60 to 80 numerical % of particles of 5 μm or less is used, the demand for the high image quality can be fulfilled, swelling of the image after the fixation can be reduced so that peel off of the image can be prevented. In the case of using such an extremely fine toner, by having the pressuring rotating member surface resistance value in a range of $10^9$ Ω to $10^{11}$ Ω, generation of image scattering due to discharge generated at the time of entrance f the recording material into the fixing nip section, or the like can be restrained so that higher image quality can be provided.

According to another aspect of the present invention, in the case of using an extremely fine toner having a 5 to 10 μm volume average particle size, and 60 to 80 numerical % of particles of 5 μm or less, since the mold releasing layer thickness of the fixing rotating member is set by 50 μm or less, and the elastic layer thickness is set in a range of 0.1 mm to 0.5 mm so as to be provided extremely thinly, heat can be supplied to the recording material efficiently while meeting the demand for the high image quality and reducing swelling of the image after the fixation so that high speed printing of an image can be realized with a high image quality.

The present document incorporates by reference the entire contents of Japanese priority document, 2001-288281 filed in Japan on Sep. 21, 2001.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A fixing unit which includes a fixing rotating member and a pressuring rotation member to be heated by a heat source provided in the fixing rotating member while forcing with each other and rotating, and which fixes an image by having a recording material with an image developed by a developer containing a toner having a 5 to 10 μm volume average particle size, and 60 to 80 numerical % of particles of 5 μm or less passing through a forcing section of the fixing rotating member and the pressuring rotating member, wherein the surface resistance value of the pressuring rotating member is in a range of $10^9$ Ω to $10^{11}$ Ω, and wherein the fixing rotating member comprises an elastic layer formed around a mandrel thereof, and a mold releasing layer formed on the surface of the elastic layer.

2. A fixing unit which includes a fixing rotating member and a pressuring rotation member to be heated by a heat source provided in the fixing rotating member while forcing with each other and rotating, and which fixes an image by having a recording material with an image developed by a developer containing a toner having a 5 to 10 μm volume average particle size, and 60 to 80 numerical % of particles of 5 μm or less passing through a forcing section of the fixing rotating member and the pressuring rotating member, wherein the fixing rotating member comprises an elastic layer formed around a mandrel thereof, and a mold releasing layer formed on the surface of the elastic layer, with the elastic layer thickness provided in a range of 0.1 mm to 0.5 mm, and the mold releasing layer thickness provided in a range of 50 $\mu$m or less.

3. A fixing unit which includes a fixing rotating member and a pressuring rotation member to be heated by a heat source provided in the fixing rotating member while forcing with each other and rotating, and which fixes an image by having a recording material with an image developed by a developer containing a toner having a 5 to 10 $\mu$m volume average particle size, and 60 to 80 numerical % of particles of 5 $\mu$m or less passing through a forcing section of the fixing rotating member and the pressuring rotating member, wherein the fixing rotating member comprises an elastic layer formed around a mandrel thereof, and a mold releasing layer formed on the surface of the elastic layer, with the elastic layer thickness provided in a range of 0.1 mm to 0.5 mm, the mold releasing layer thickness provided in a range of 50 $\mu$m or less, and the surface resistance value of the pressuring rotating member provided in a range of $10^9$ Ω to $10^{11}$ Ω.

4. An image formation apparatus comprising, a fixing unit which includes a fixing rotating member and a pressuring rotation member to be heated by a heat source provided in the fixing rotating member while forcing with each other and rotating, and which fixes an image by having a recording material with an image developed by a developer containing a toner having a 5 to 10 $\mu$m volume average particle size, and 60 to 80 numerical % of particles of 5 $\mu$m or less passing through a forcing section of the fixing rotating member and the pressuring rotating member, wherein the surface resistance value of the pressuring rotating member is in a range of $10^9$ Ω to $10^{11}$ Ω, and wherein the fixing rotating member comprises an elastic layer formed around a mandrel thereof, and a mold releasing layer formed on the surface of the elastic layer.

5. An image formation apparatus comprising, a fixing unit which includes a fixing rotating member and a pressuring rotation member to be heated by a heat source provided in the fixing rotating member while forcing with each other and rotating, and which fixes an image by having a recording material with an image developed by a developer containing a toner having a 5 to 10 $\mu$m volume average particle size, and 60 to 80 numerical % of particles of 5 $\mu$m or less passing through a forcing section of the fixing rotating member and the pressuring rotating member, wherein the fixing rotating member comprises an elastic layer formed around a mandrel thereof, and a mold releasing layer formed on the surface of the elastic layer, with the elastic layer thickness provided in a range of 0.1 mm to 0.5 mm, and the mold releasing layer thickness provided in a range of 50 $\mu$m or less.

6. An image formation apparatus comprising, a fixing unit which includes a fixing rotating member and a pressuring rotation member to be heated by a heat source provided in the fixing rotating member while forcing with each other and rotating, and which fixes an image by having a recording material with an image developed by a developer containing a toner having a 5 to 10 $\mu$m volume average particle size, and 60 to 80 numerical % of particles of 5 $\mu$m or less passing through a forcing section of the fixing rotating member and the pressuring rotating member, wherein the fixing rotating member comprises an elastic layer formed around a mandrel thereof, and a mold releasing layer formed on the surface of the elastic layer, with the elastic layer thickness provided in a range of 0.1 mm to 0.5 mm, the mold releasing layer thickness provided in a range of 50 $\mu$m or less, and the surface resistance value of the pressuring rotating member provided in a range of $10^9$ Ω to $10^{11}$ Ω.

* * * * *